US006050364A

United States Patent [19]

Popall et al.

[11] Patent Number: 6,050,364

[45] Date of Patent: Apr. 18, 2000

[54] SIT HARNESS OR ROPING HARNESS ADJUSTABLE IN HEIGHT

[75] Inventors: Peter Popall, Saint Pancrasse; Paul Petzl, Barraux, both of France

[73] Assignee: Zedel, Crolles, France

[21] Appl. No.: 09/029,377

[22] PCT Filed: Jul. 3, 1997

[86] PCT No.: PCT/FR97/01197

§ 371 Date: Feb. 26, 1998

§ 102(e) Date: Feb. 26, 1998

[87] PCT Pub. No.: WO98/01187

PCT Pub. Date: Jan. 15, 1998

[30] Foreign Application Priority Data

Jul. 4, 1996 [FR] France ..... 96 08561

[51] Int. Cl.[7] ..... A62B 35/00

[52] U.S. Cl. ..... 182/6

[58] Field of Search ..... 182/3, 6, 7

[56] References Cited

U.S. PATENT DOCUMENTS

| | | | |
|---|---|---|---|
| 2,979,028 | 4/1961 | Zakely | 182/6 |
| 3,869,021 | 3/1975 | Sutherland | 182/6 |
| 5,615,750 | 4/1997 | Phillips | 182/6 |

FOREIGN PATENT DOCUMENTS

| | | | |
|---|---|---|---|
| 2221910 | 3/1973 | France | 182/6 |
| 2933771 | 3/1981 | Germany | 182/6 |

*Primary Examiner*—Alvin Chin-Shue
*Attorney, Agent, or Firm*—Oliff & Berridge, PLC

[57] ABSTRACT

A sit harness comprises a pair of leg loops joined to a belt by means of a link webbing passing through a securing ring. The securing ring includes an adjustment mechanism for the heightwise positioning of the link webbing to adjust the leg loop module with respect to the belt according to the distance between the user's crotch and waist. The adjustment mechanism is advantageously formed by at least one intermediate strand subdividing the inside of the ring into super-posed orifices arranged at different positioning levels.

8 Claims, 3 Drawing Sheets

SIT HARNESS OR ROPING HARNESS ADJUSTABLE IN HEIGHT

The invention relates to a sit harness or roping harness comprising:

- a belt equipped with a closing device and able to be adjusted to fit the user's waist,
- a pair of leg loops joined to one another at the front by a central link webbing shaped as an inverted V,
- and a securing ring designed to join the link webbing to the ventral part of the belt, said closed ring being arranged to assemble the leg loop module to the belt and to act at the same time as attachment part for a carabiner.

Known roping sit harnesses of the kind referred to comprise a link ring formed by a single closed loop, through which the belt passes at the top and the link webbing at the bottom. The use of such a loop renders any adjustment by the user of the positioning of the leg loops with respect to the belt impossible. However the distance from the crotch to the waist varies according to the sex. It is in fact larger in women. The manufacturer has, for the same model, to provide several ranges of sizes according to the morphology and sex of the users. Leg loops for men of different sizes (small, medium, large) are thus to be found, as well as leg loops for women also of different sizes. Marketing such a range involves high production costs for the manufacturer and high stocking costs for wholesalers.

The document FR-A-2,649,618 describes a sit harness with an adjustable belt, wherein the front part of the leg loops is sewn onto the ventral strap of the belt by W-shaped webbings. The attachment ring is secured to the belt by a seam. There is no possibility of adjusting the heightwise positioning of the leg loops with respect to the belt according to the distance between the user's crotch and waist.

The document EP-A-0,477,110 refers to a sit harness for rock climbing having a closed securing ring, but not provided with height adjustment means.

SUMMARY OF THE INVENTION

The object of the invention is to achieve an adjustable roping sit harness providing optimum comfort regardless of the morphology and sex of the user.

The sit harness according to the invention is characterized in that the securing ring comprises in addition means for adjusting the heightwise positioning of the link webbing to adjust the leg loop module with respect to the belt according to the distance between the user's crotch and waist.

The positioning of the leg loops with respect to the belt can thus be adjusted while keeping the level of fixing of the attachment carabiner in the upper part of the closed ring.

According to a first embodiment, the height adjustment means are formed by at least one intermediate strand subdividing the inside of the ring into superposed openings arranged one above the other. The intermediate strand is sewn onto the opposite side faces of the webbing constituting the closed ring and extends orthogonally with respect to the ventral part of the belt passing through said ring.

According to a second embodiment, the height adjustment means are formed by at least two closed securing rings presenting different sizes.

The central part of the link webbing is advantageously provided with an auxiliary webbing with a clasp designed to achieve balanced centering of the leg loop module with respect to the ring.

BRIEF DESCRIPTION OF THE DRAWINGS

Other advantages and features of the invention will become more clearly apparent from the following description of an embodiment thereof, given as a non-restrictive example only, and represented in the accompanying drawings, in which.

DETAILED DESCRIPTION

Figure 1:
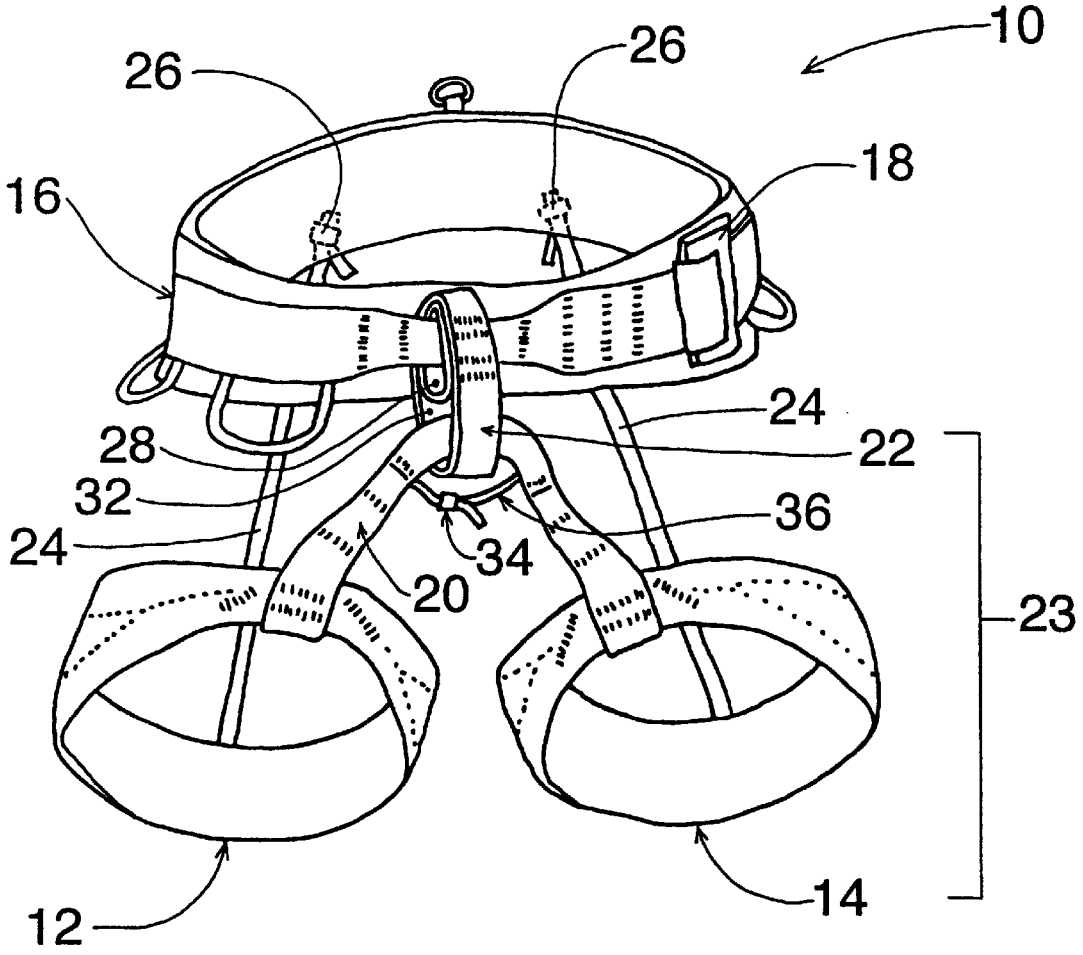
FIG. 1 is a perspective view of an adjustable sit harness according to the invention.

With reference to FIG. 1, a sit harness 10 or roping harness comprises a pair of leg loops 12, 14 associated to a belt 16 which is equipped with a closing device 18 or clasp fixed to one of the ends of the belt 16. The closing device 18 is arranged on the lateral side and cooperates with the opposite end of the belt 16 for the purposes of adjusting the circumference to fit the user's waist.

The belt 16 and leg loops 12, 14 are made from a flexible material with a high mechanical strength, notably polyamide webbing. Each leg loop 12, 14 is formed by a closed loop which may be without individual adjustment (case of FIG. 1) or be equipped with adjusting means designed to adjust the leg loop size to suit the user's morphology.

At the front, the two leg loops 12, 14 are joined to one another by a central link webbing 20 joined to the belt 16 by means of a securing ring 22. The pair of leg loops 12, 14 and the link webbing 20 form the leg loop module 23 of the sit harness 10. The rear part of each leg loop 12, 14 is joined to the back part of the belt 16 by an elastic strap 24 which is provided at the upper end with a removable attachment part 26.

The securing ring 22 is held captive in the ventral part of the belt 16 and extends in an appreciably vertical plane, said belt 16 passing through the ring horizontally. It performs a first function of assembling the link webbing of the leg loop module 23 to the belt 16, and a second function of attaching a carabiner for belaying or rappelling. The ring 22 is achieved by means of a sewn webbing forming a closed loop.

According to the invention, the securing ring 22 is provided with at least one intermediate strand 28 subdividing the inside of the ring 22 into two openings 30, 32 superposed at different heightwise levels. The intermediate strand 28 is sewn onto the opposite side faces of the ring 22 and extends orthogonally with respect to the horizontal ventral part of the belt 16.

The central part of the link webbing 20 is provided with an auxiliary strap or lanyard 34 provided with a closing clasp 36 and designed to achieve balanced centering of the module 23 regardless of the forces exerted on the leg loops 12, 14 in the dynamic phase.

Depending on the morphology of the user, in particular the heightwise distance between the crotch and the waist, the link webbing 20 is passed through one of the two openings 30, 32 of the ring 22. These two adjustment positions are illustrated in FIGS. 2 and 3, the link webbing 20 being shaped as an inverted V in both cases.

Figure 2:
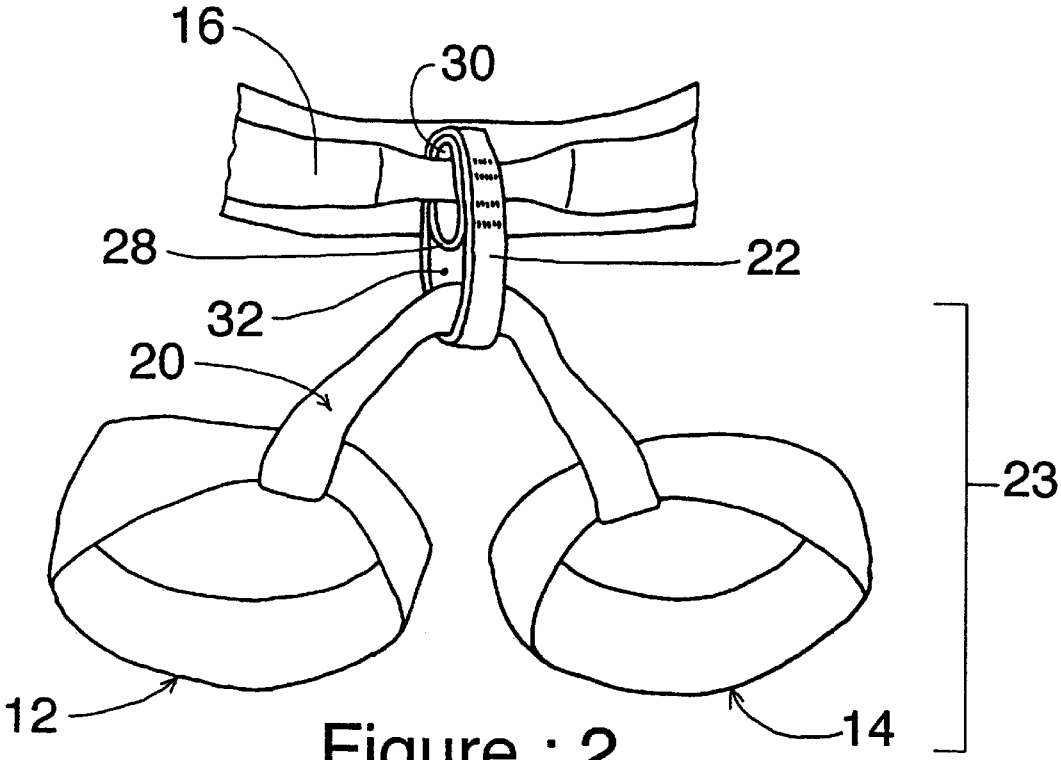
FIGS. 2 and 3 show partial views of FIG. 1, respectively in the lower position and in the upper position of the leg loop module, the auxiliary webbing not being represented.

In the first lower position of FIG. 2, positioning of the link webbing 20 in the lower opening 32 is performed by passing one of the leg loops through the same opening 32 and centering the module 23 after the auxiliary webbing 34 has been fitted in place around the external face of the ring 22. Closing of the clasp 36 prevents any sliding of the link webbing 20 and prevents the module 23 from being off-centred. The intermediate strand 28 remains inactive during this adjustment mode.

Figure 3:
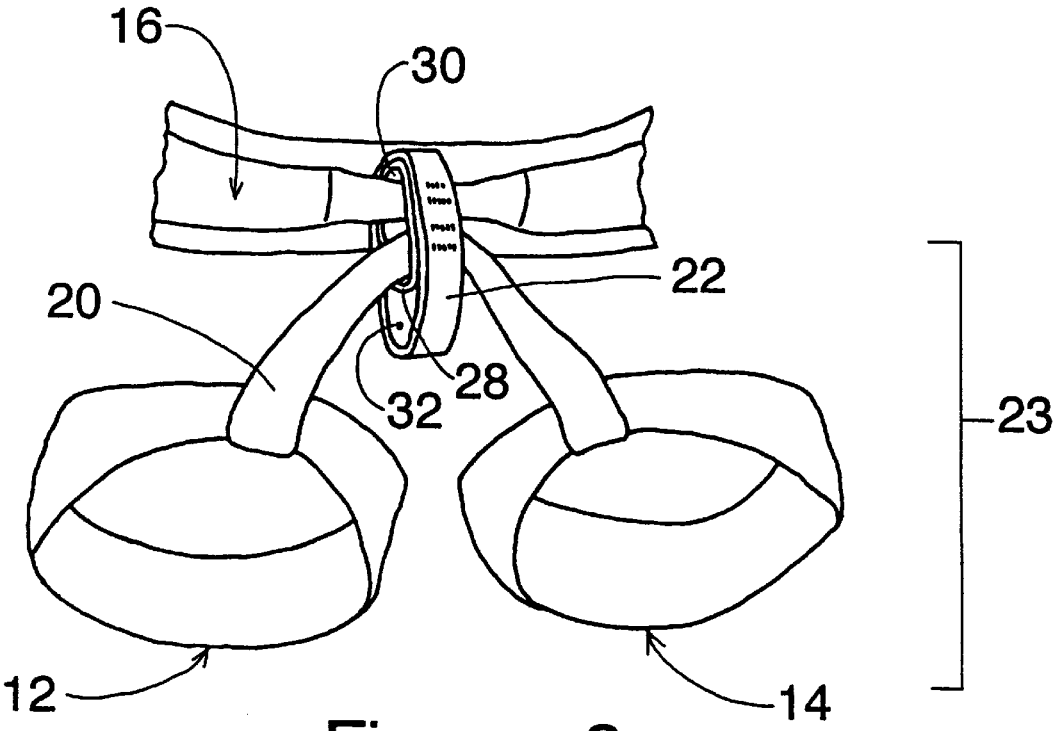

In the second upper position of FIG. 3, the link webbing 20 passes through the upper opening 30 and bears directly on the intermediate strand.

For a sit harness of predetermined size, fitting the link webbing 20 in one of the superposed openings 30, 32 enables the leg loops 12, 14 to be positioned heightwise with respect to the belt 16. The attachment carabiner (not represented) is fitted in the upper opening 30 for both of the adjustments of the module 23.

To change from one adjustment position to the other adjustment position, the leg loop module 23 has to be disassembled. Starting from FIG. 1, the closing clasp 36 first has to be opened releasing the auxiliary strap 34, then the straps 24 of the belt 16 are released by opening the attachment parts 26. The module 23 then simply has to be extracted by passing one of the leg loops through the lower opening 32. Fitting of the webbing 20 of the module 23 in the upper opening 30 of the second adjustment position is achieved by performing the process described above in reverse.

It is clear that the securing ring 22 can have more than two height adjustment positions. Several intermediate strands 28 are then required, enabling the precision to be improved by means of a fine adjustment of the heightwise positioning of the module 23.

The webbing forming the securing ring 22 can also be replaced by a ring made of metallic material.

Figure 4:
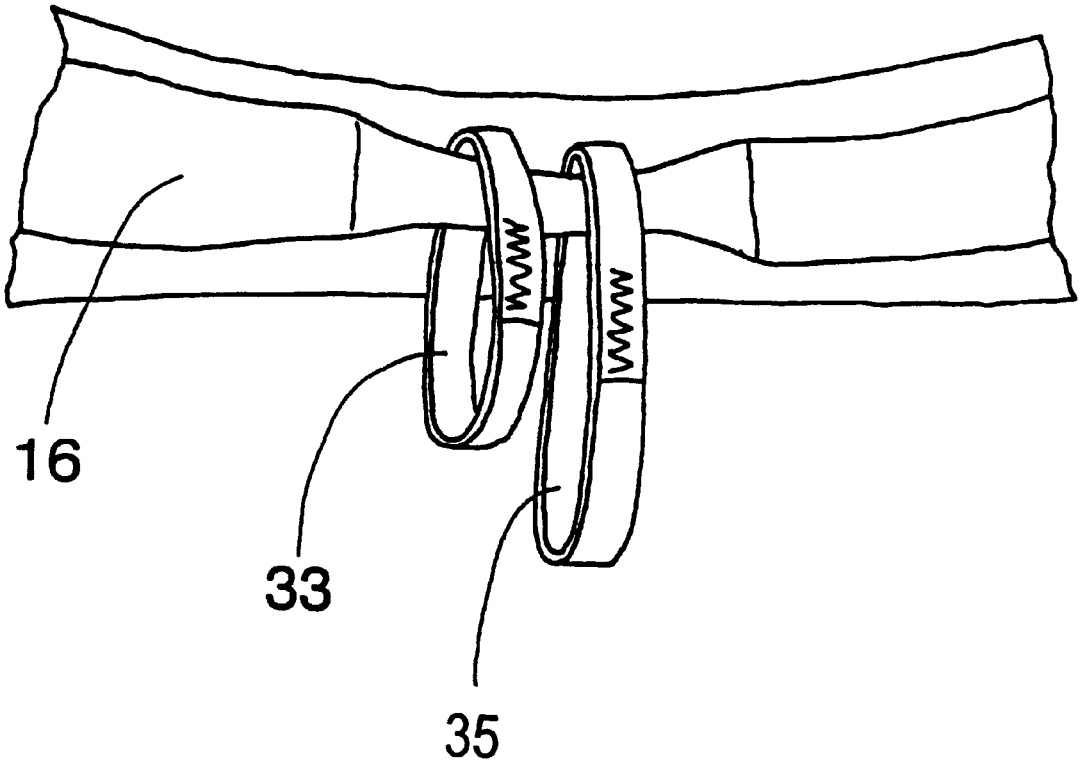
FIG. 4 is a partial view of FIG. 2 of an alternative embodiment.

In FIG. 4, the securing ring 22 with two levels described previously is replaced by at least two single rings 33, 35 of different sizes. The rings 33, 35 are closed and can be independent from one another being arranged side by side, the belt 16 passing through them jointly. It is also possible to sew the small ring 33 onto the internal upper part of the large ring 35.

A sit harness model of predetermined size can thus be adapted to the different morphologies and different pelvis heights of the users. Correct positioning of the leg loop module 23 with respect to the belt 16 affords the user optimum comfort; whether he is standing, climbing, or secured to one of the rings 22, 33, 35 when he is suspended in his harness.

What is claimed is:

1. A sit harness or roping harness comprising:

a belt equipped with a closing device and able to be adjusted to fit a user's waist, a leg loop module comprising a pair of leg loops joined to one another at a front by a central link webbing shaped as an inverted V, a securing ring that joins the link webbing to a ventral part of the belt, said ring including a closed strap, the link webbing and the belt passing through the securing ring to assemble the leg loop module to the belt and to act at the same time as an attachment in an upper part for a carabiner; and at least one intermediate strand subdividing the inside of the closed strap into at least two superposed openings arranged at different heightwise positioning levels;

wherein the link webbing passes through a selected one of said at least two superposed openings to connect the leg loop module with respect to the belt according to the distance between the user's crotch and waist.

2. The sit harness according to claim 1, wherein the at least one intermediate strand is sewn onto the opposite side faces of said closed strap.

3. The sit harness according to claim 2, wherein the at least one intermediate strand extends orthogonally with respect to the ventral part of the belt.

4. The sit harness according to claim 1, wherein the central part of the link webbing is provided with an auxiliary strap with a closing clasp to achieve balanced centering of the leg loop module with respect to the securing ring.

5. The sit harness according to claim 4, wherein the auxiliary strap is arranged around the external face of the securing ring and opposite from the belt.

6. A harness comprising:

a belt, equipped with a closing device, that can be adjusted to fit a user's waist, a leg loop module comprising a pair of leg loops joined to one another at a front by a central link webbing shaped as an inverted V, and at least two securing rings of different sizes for connecting the link webbing to a ventral part of the belt and providing an attachment for a carabiner, wherein the belt passes through the at least two securing rings and the link webbing passes through a smaller one of the at least two securing rings and a larger one of the at least two securing rings to connect the leg loop module with respect to the belt at a closer and further distance between the belt and the pair of leg loops, respectively.

7. The harness according to claim 6, wherein the link webbing includes an auxiliary strap with a closing clasp to achieve balanced centering of the leg loop module with respect to the one of the at least two securing rings through which the link webbing passes.

8. The harness according to claim 7, wherein the auxiliary strap is arranged around the external face of the one of at least two securing rings through which the link webbing passes and opposite from the belt.

* * * * *